United States Patent [19]

Formanek et al.

[11] Patent Number: 4,716,705

[45] Date of Patent: Jan. 5, 1988

[54] NATURAL WOOD SURFACE TREATMENT FOR AN INSULATED DOOR

[76] Inventors: James L. Formanek, Box 35; Larry J. Formanek, Rte. 2, Box 126, both of Lindsay, Nebr. 68644

[21] Appl. No.: 880,198

[22] Filed: Jun. 30, 1986

[51] Int. Cl.[4] ..... E06B 3/72

[52] U.S. Cl. ..... 52/785; 52/316; 52/809

[58] Field of Search ..... 52/785, 316, 455, 809; 312/257 A, 204; 156/257, 268

[56] References Cited

U.S. PATENT DOCUMENTS

| | | | |
|---|---|---|---|
| 4,097,100 | 6/1978 | Sauder | 52/316 X |
| 4,546,585 | 10/1985 | Governale | 52/455 X |
| 4,570,399 | 2/1986 | Wentink | 52/455 X |

FOREIGN PATENT DOCUMENTS

| | | | |
|---|---|---|---|
| 2415529 | 10/1975 | Fed. Rep. of Germany | 52/316 |
| 432609 | 7/1935 | United Kingdom | 52/785 |

*Primary Examiner*—J. Karl Bell

*Attorney, Agent, or Firm*—Zarley, McKee, Thomte, Voorhees & Sease

[57] ABSTRACT

A natural wood surface treatment for an insulated door, in a preferred embodiment, a periphery of wood boards surrounding a grouping of raised panel inserts separated by center rails so that the assembled boards, inserts and center rails define a front panel for the door. The peripheral boards have grooves in the interior edges for receiving the center rails and raised panel inserts. To secure the front panel to the door, the peripheral boards have exterior grooves for slidably receiving inwardly directed flanges on the door side walls and bottom wall. A channel-shaped top cap secures the front panel along the top of the door.

In another embodiment, openings are cut into the metal or nonwood front panel of a conventional insulated door for receiving assemblies of one or more raised panel inserts with natural wood moulding strips around them.

8 Claims, 30 Drawing Figures

NATURAL WOOD SURFACE TREATMENT FOR AN INSULATED DOOR

BACKGROUND OF THE INVENTION

The present invention is directed generally to an improved insulated door and more particularly to an insulated door having the usual structural and thermal characteristics yet with at least one surface having the beauty and repairability of natural wood.

Natural wood doors are desirable both for their aesthetic appearance and because a natural wood surface can be touched up or repaired quite easily and undetectably. A disadvantage of the solid natural wood doors is that they are becoming almost prohibitively expensive and also that they tend to warp over the years resulting in gaps of up to ⅜ inches between the door and frame.

Metal insulated doors are desirable for their structural integrity and also for the insulation value afforded by the insulation filling the hollow interior of the door. Disadvantages of the metal insulated doors include the difficulty of applying an attractive finish on the surface and the greater difficulty of matching and repairing that surface in the event that it is marred or damaged. Metal doors can be formed to resemble the shape of a wood door with raised panel inserts but the metal surface must generally be antiqued to simulate a wood appearance. The antiquing treatment is easily scratchable and it is extremely difficult to match colors and texture design of the antiquing surface when making repairs.

Accordingly, a primary object of the invention is to provide an improved insulated door.

Another object is to provide an improved insulated door having at least one natural wood surface.

Another object is to provide an insulated door having the beauty and repairability of a natural wood door and the structural and thermal characteristics of a conventional insulated door.

Another object is to provide an improved insulated door which may be fabricated by modifying a conventional insulated metal door.

Another object is to provide an improved insulated door having a natural wood surface ridigly secured thereto.

Another object is to provide an improved insulated door which is rugged in construction, inexpensive to manufacture and attractive in appearance.

SUMMARY OF THE INVENTION

The natural wood surface treatment for an insulated door, according to the present invention, broadly encompasses the combination of a nonwood insulated door having at least one panel with a natural wood exterior surface for aesthetic beauty and improved repairability. In one embodiment, wood boards surround a grouping of raised panel inserts so that the assembled boards and inserts define a front panel for the door. The boards have grooves in the interior edges thereof for receiving the raised panel inserts. To secure the front panel to the door, the door side walls are provided with inwardly protruding flanges and the front panel is provided with a peripheral groove for slidably receiving the side wall flanges. The bottom wall of the door may have an upwardly protruding flange for receipt within the peripheral groove along the bottom of the front panel and a top cap secures the front panel at the top edge of the door.

In another embodiment, openings are cut into the metal or other nonwood front panel of a conventional insulated door for receiving assemblies of one or more raised panel inserts with natural wood moulding strips around them. The moulding strips have a groove along the interior edges for receiving one edge of a raised panel insert. Sufficient insulation is cut out from the opening to provide room for seating the moulding strips and raised panel inserts on the front panel within the opening. After inserting and fastening the raised panel and moulding strip assemblies, any remaining exposed nonwood surfaces are covered with natural wood veneer to afford substantially the same appearance as a solid wood door.

Center rails may be interposed between the raised panel inserts in the panel and moulding strip assemblies so that a single assembly may include two, four, six or any other desired number of inserts, thereby reducing the number of assemblies to be installed into the front panel as well as the associated labor.

DESCRIPTION OF THE PREFERRED EMBODIMENTS

Figure 1:
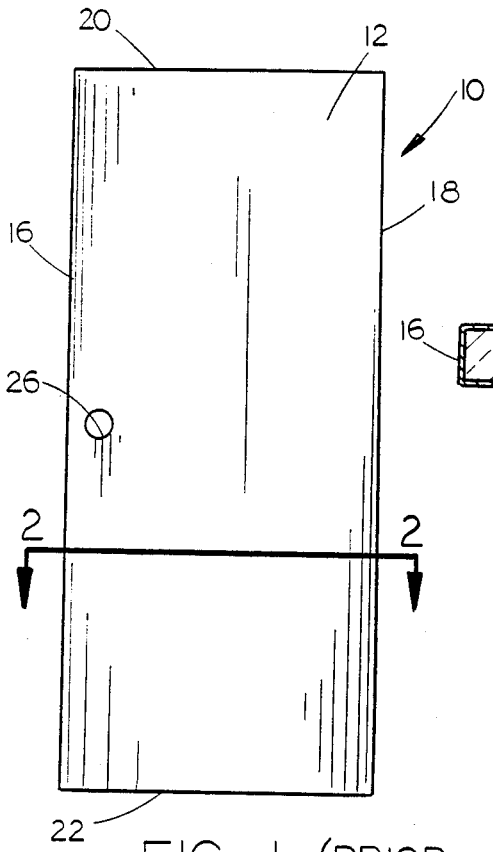
FIG. 1 (PRIOR ART)
FIG. 1 is a front elevational view of a conventional metal insulated door.
Figure 2:
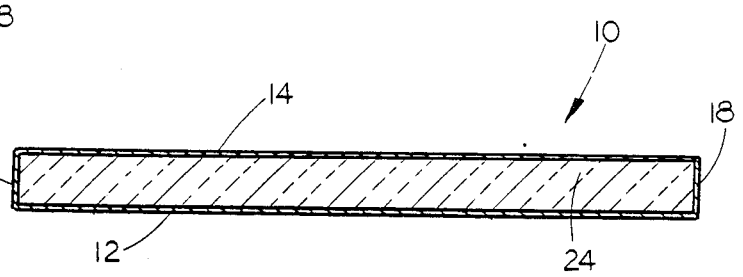
FIG. 2 (PRIOR ART)
FIG. 2 is an enlarged top sectional view taken along line 2—2 in FIG. 1.

The natural wood surface treatment, according to the present invention, is illustrated in connection with the conventional metal insulated door in FIGS. 1 and 2. The door includes a front panel 12, rear panel 14, side walls 16 and 18 and top and bottom walls 20 and 22. These panels and walls define an enclosure filled with thermal insulation material 24, generally a styrofoam-like material. A door handle opening 26 extends through both panels and the insulation. The front panel 12 may be flat, as illustrated in FIG. 1, or it may have a design resembling raised panel inserts stamped into it.

Figure 3:
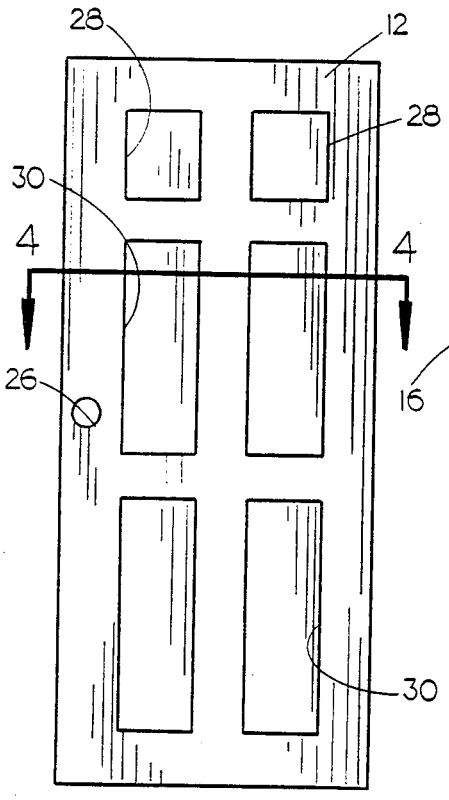
FIG. 3 is a front elevational view of the metal insulated door with portions of the front panel cut out.
Figure 4:
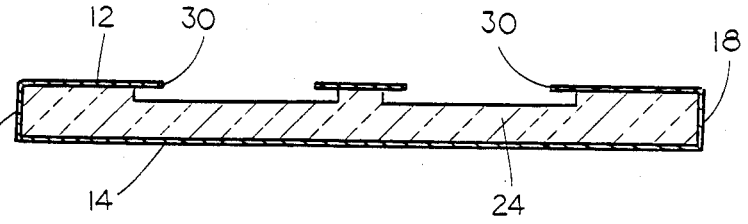
FIG. 4 is an enlarged top sectional view taken along line 4—4 in FIG. 3.
Figure 5:
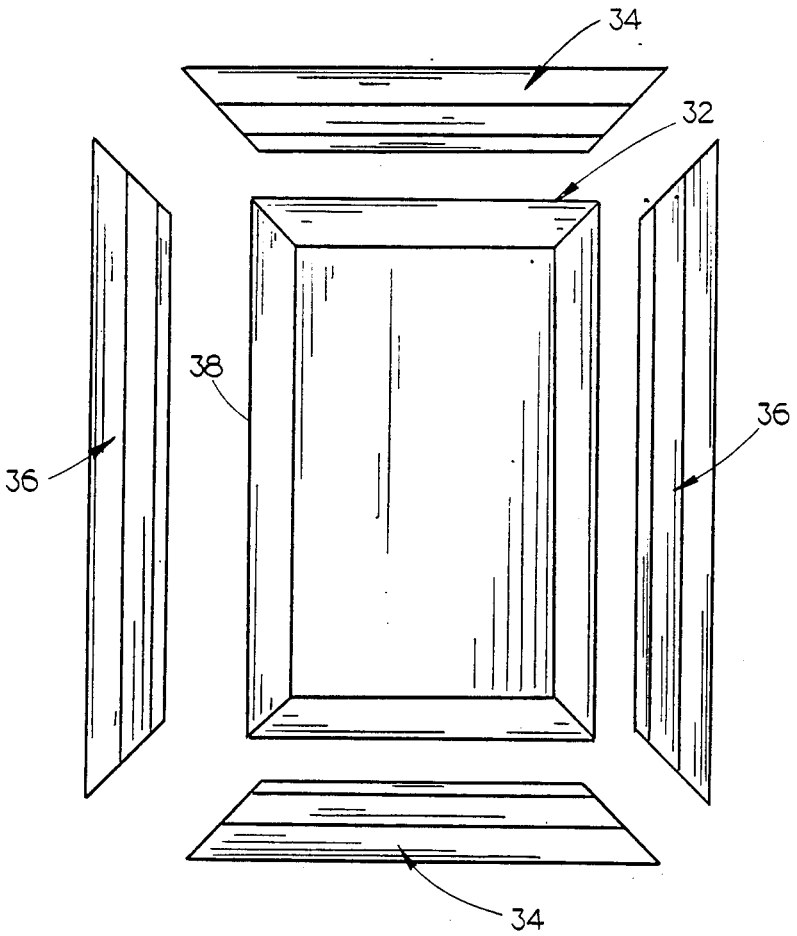
FIG. 5 is an exploded front view of a raised panel insert and surrounding moulding strips of the invention.

According to the present invention, a series of openings 28 and 30 are cut in front panel 12, as shown in FIGS. 3 and 4. A thickness of insulation is then removed behind each opening and below edges surrounding the opening to define a recess for receiving insert assemblies described below. An effective way of removing the desired amount of insulation is to insert a hot wire through the opening and guiding the wire across the opening to cut out the portion of insulation to be removed.

Figure 6:
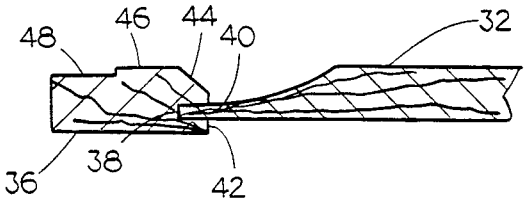
FIG. 6 is an enlarged side sectional view of a raised panel insert fit within the groove of a moulding strip.

For each opening, there is provided a raised panel insert 32 and a series of moulding strips 34 and 36. As shown in FIG. 6, the raised panel insert 32 comprises a flat board with an arcuate outward taper along each edge substantially reducing the thickness at the exterior edge 38.

Figure 8:
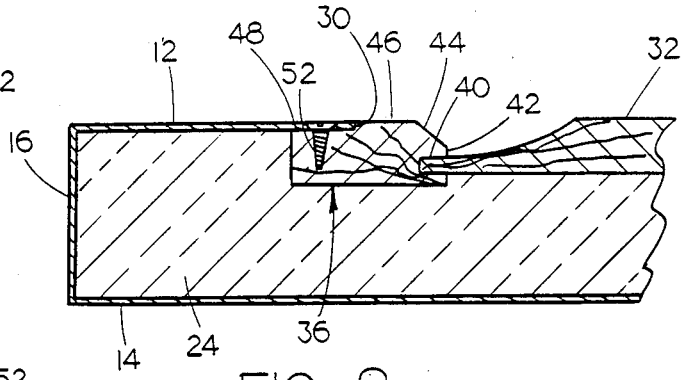
FIG. 8 is an enlarged partial top sectional view taken along line 8—8 in FIG. 7.
Figure 9:
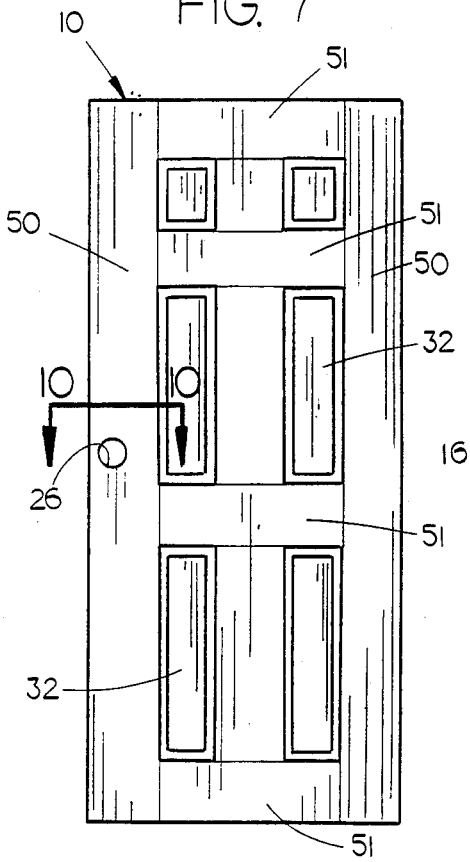
FIG. 9 is a front elevational view of the metal insulated door with wood veneer covering the exposed metal of the front panel.
Figure 10:
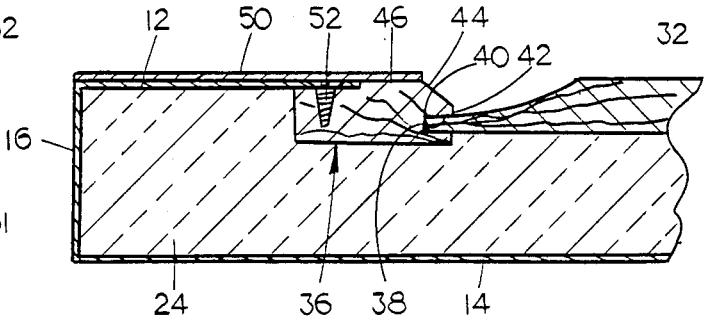
FIG. 10 is an enlarged partial top sectional view taken along line 10—10 in FIG. in 9.

The moulding strips 34 and 36 are of identical cross-sectional shape, as illustrated in FIG. 6, including a groove 40 in an interior edge 42 for receiving an exterior edge 38 of a raised panel insert 32. The top interior corner is tapered as at 44 for a base shoe effect around the raised panel insert 32. The moulding top surface 46 has a depression 48 along an exterior portion for seating the moulding along an edge of opening 30 as shown in FIG. 8. The depth of depression 48 is the same as the thickness of front panel 12 so that a flush surface is presented for applying a width near cover strip 50 as shown in FIGS. 9 and 10.

Figure 7:
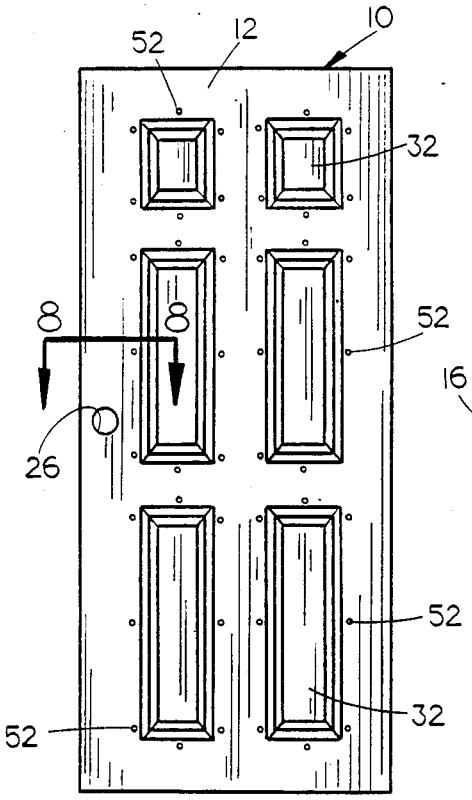
FIG. 7 is a front elevational view of the insulated metal door having raised panel inserts secured in the openings thereof by the moulding strips.

Thus the process of the invention involves routing or otherwise cutting the openings 28 and 30 in front panel 12 followed by removal of sufficient insulation material 24 to enable insertion of the natural wood assemblies. Moulding strips 34 and 36 are provided to receive and support the raised panel insert 32. The assembled moulding strips and raised panel insert 32 are then secured in the openings 28 and 30 with a plurality of wood screws 52 extended through the front panel adjacent the openings 28 and 30 as shown in FIG. 7. It may be desirable to then insert foam back around the inserted assembly to improve energy efficiency and to help secure the assembly. The next steps are cleaning the surface from paint, foam and the like and making sure the screws 52 and edges are flush with the surface of front panel 12. Next, the veneer facing material 50 51 are cut. Adhesive is applied to the front panel 12 and facings 50, 51. A contact cement is preferred so one has to allow drying time until the surface is not tacky to the touch. The facing material 50, 51 is then exactly positioned on the front panel whereupon pressure is applied for secure bondage. A router is then used to cut off excess material and around any lock and window openings. For a finished effect, it may be desirable to sand the edge of the door veneer 50, 51 and wood around the raised panels 32 to give a rounded wood effect. The natural wood exterior surface of the door is then ready to finish as desired.

The wood that is used may be oak, birch, ash, mahogany or other various woods to match the owner's taste and budget.

Figure 13:
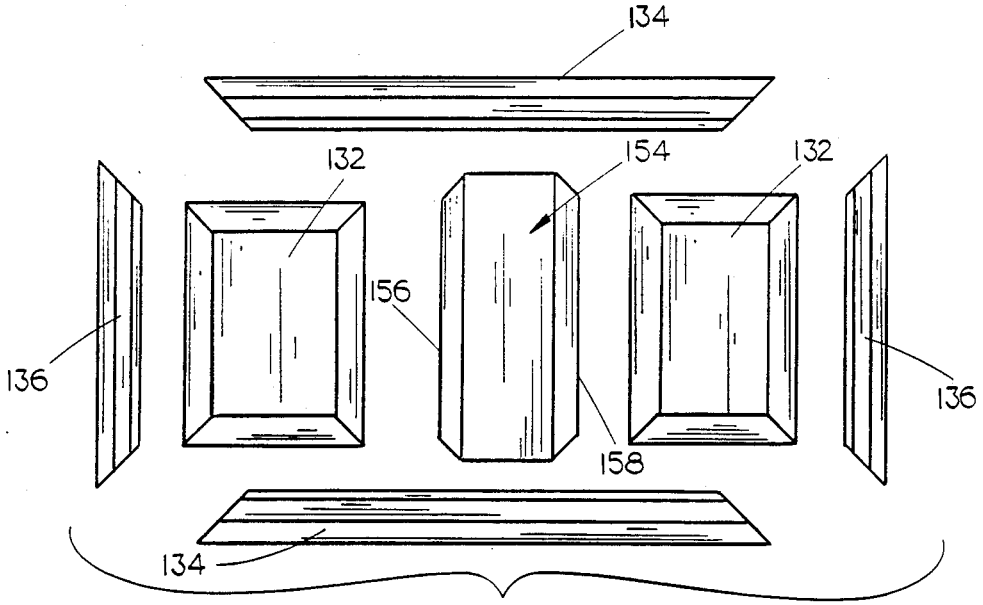
FIG. 13 is an exploded view of a pair of raised panel inserts, center rail and moulding strips for insertion into one opening of the door of FIG. 11.
Figure 14:
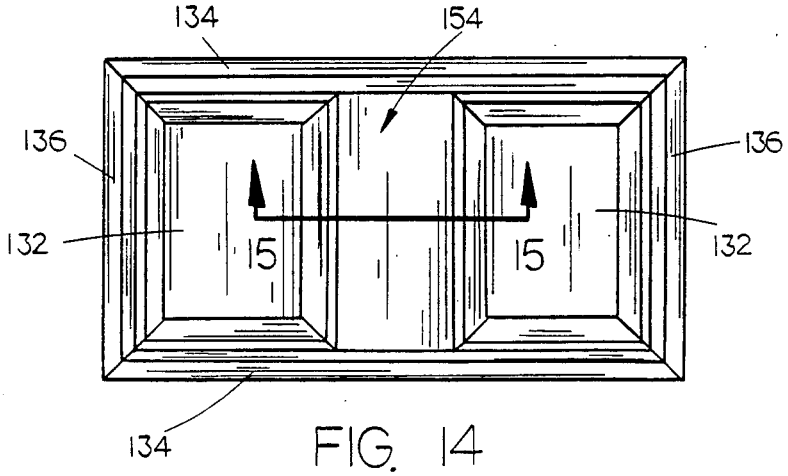
FIG. 14 is a front view of the parts of FIG. 13 in assembled relation.
Figure 15:
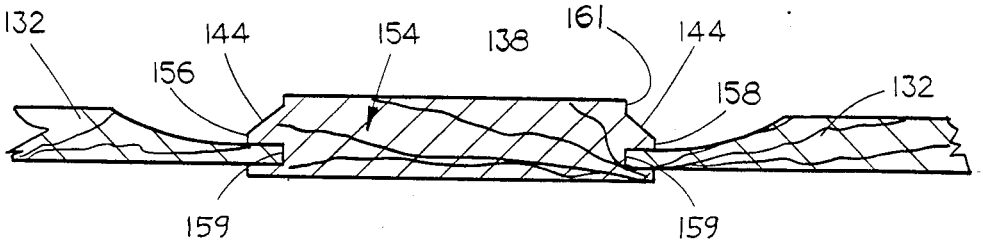
FIG. 15 is an enlarged partial bottom sectional view taken along line 15—15 in FIG. 14.
Figure 11:
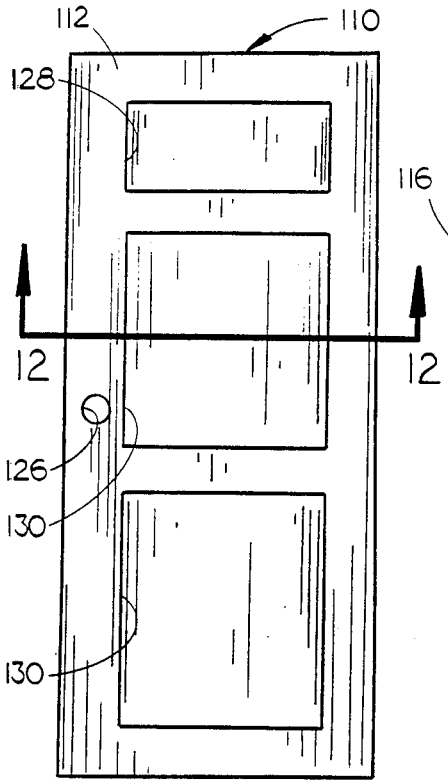
FIG. 11 is a front elevational view of an insulated door with fewer and larger openings in the front panel in comparison to the door of FIG. 3.
Figure 12:
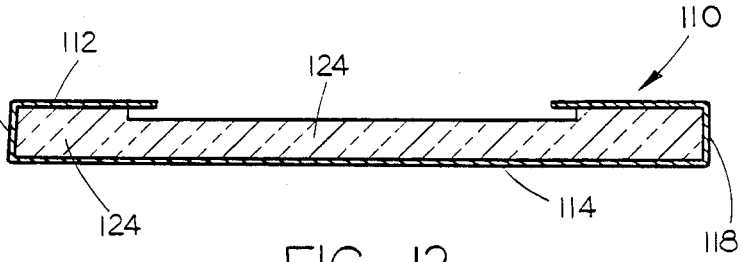
FIG. 12 is an enlarged bottom sectional view taken along line 12—12 in FIG. 11.

FIGS. 11–18 illustrate another embodiment of the invention wherein each insert assembly includes a pair of raised panel inserts. Because most of the structure closely resembles that of the embodiment of FIGS. 1–10, parts are referred to with like numerals, but in the 100 series. Accordingly, the front panel 112 of metal door 110 has three openings 128 and 130 cut therefrom. The insulation material 124 around the opening is removed as illustrated in FIG. 12. As shown in FIG. 13, each insert assembly includes, in addition to the moulding strips 134 and 136 and raised panel inserts 132, an upright center rail 154. Center rail 154 has opposite side edges 156 and 158 and a groove 159 along each side edge adapted for receiving an edge 138 of a raised panel insert 132, as shown in FIG. 15. Center rail 154 is constructed similarly to the moulding strips 134 and 136 except that it is wider to accommodate the transverse spacing between the raised panel inserts and the top surface is raised at the upper ends of the corner tapers 144 by a thickness indicated at 161 in FIG. 15 which corresponds to the thickness of the veneer cover strips 151.

Figure 17:
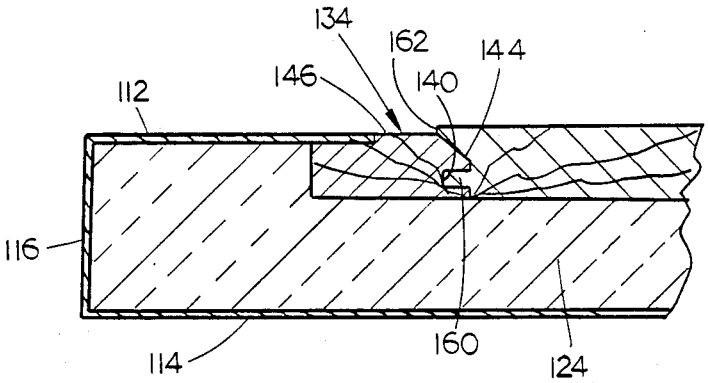
FIG. 17 is an enlarged partial side sectional view taken along line 17—17 in FIG. 16.
Figure 16:
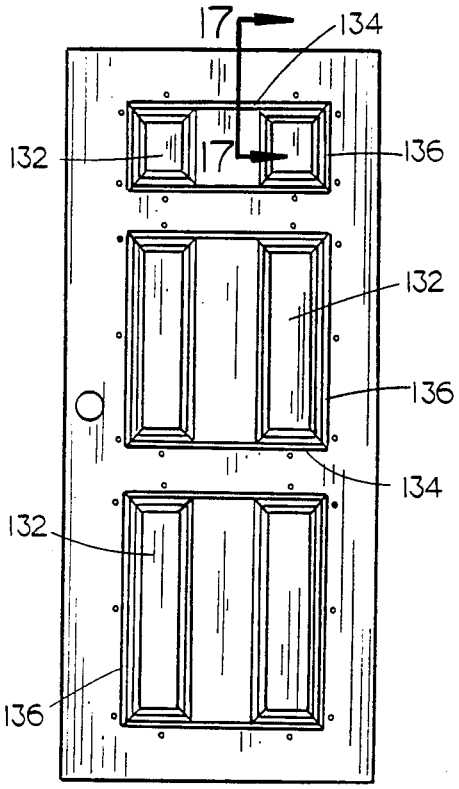
FIG. 16 is a front elevational view of the door of FIG. 11 with raised panel inserts secured in the openings thereof by the center rails and moulding strips.
Figure 18:
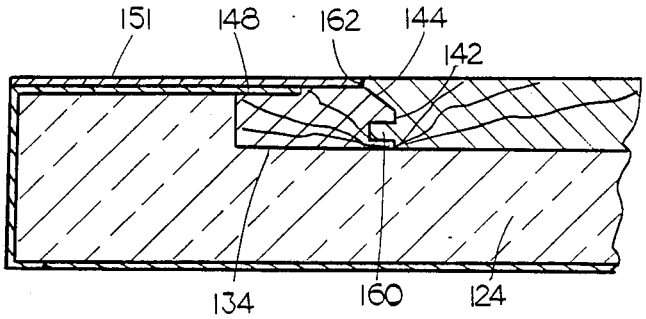
FIG. 18 is an enlarged partial side sectional view similar to FIG. 17 but with the wood veneer adhered thereto.

Moulding strip 134 includes a continuous groove 140 along the interior edge thereof as illustrated in FIGS. 17 and 18. Each longitudinal end of center rail 154 includes a matching tongue 160 for receipt within groove 140 and may be finished to conform to tapered corner 144, yet provide a ridge 162 for engagement with the edge of the veneer cover strip 151 as shown in FIG. 18. The result is a finished door which is identical in appearance to the door of FIG. 9 but which includes only half as many insert assemblies.

Figure 19:
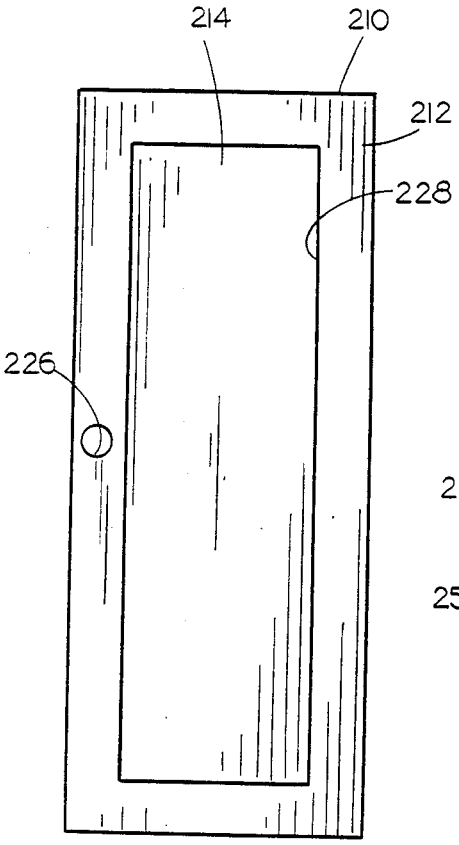
FIG. 19 is a front elevational view of an insulated metal door with a single large opening in the front panel.
Figure 20:
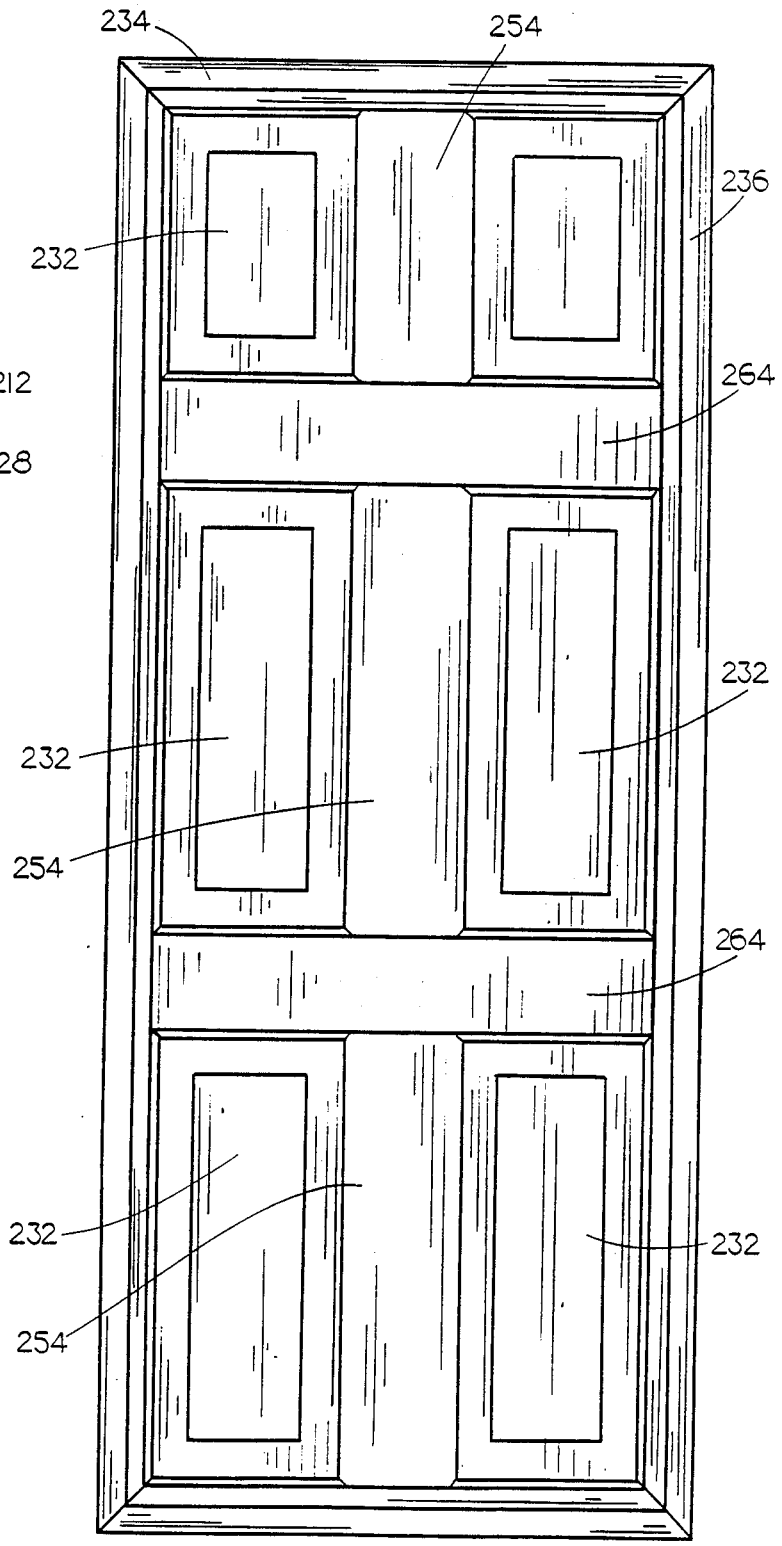
FIG. 20 is a front elevational view of an assembly of raised panel inserts, center rails and moulding strips forming an insert for the door of FIG. 19.

Likewise, a still further embodiment of the invention is illustrated in FIGS. 19 and 20 wherein all six raised panel inserts 232 are included in a single insert assembly adapted to fit within a single opening 228 in the front panel 212 of metal door 210. Again, structure similar to that previously described is simply indicated by reference numerals in the 200 series without a repeated description.

The significant difference from the second embodiment of FIGS. 11–18 is the addition of the transverse center rails 264 which coact with the upright center rails 254 and moulding strips 234 and 236 to support and position the raised panel inserts 232. Except for length, the transverse center rails 264 are identical to the upright center rail 254. Thus the juncture between the transverse center rails 264 and upright center rails 254 affords a flush fitted top surface. Significant labor savings are achieved in the construction of the embodiment of FIGS. 19 and 20 wherein only a single door opening 258 is formed and only a single insert assembly need be secured therein.

Figure 22:
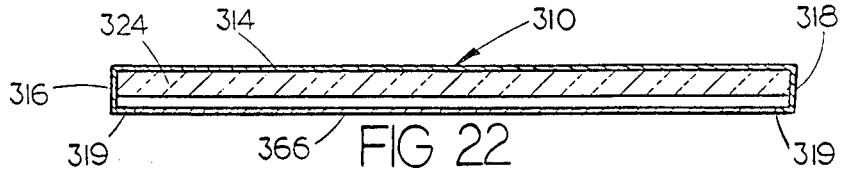
FIG. 22 is an enlarged top view of the door of FIG. 21.
Figure 21:
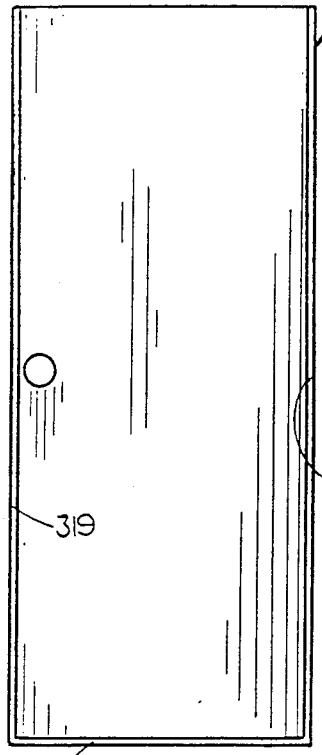
FIG. 21 is a front elevational view of a modified insulated door without a front panel and including turned in flanges along the bottom and two sides thereof.

A fourth and preferred embodiment of the invention is illustrated in FIGS. 21–30. In this embodiment, a custom metal or nonwood door 310 is provided which does not have a front panel. The cross-sectional shape is shown in FIG. 22 as including a rear panel 314 and side walls 316 and 318, each of which terminates at its forward end in an inwardly protruding flange 319. Similarly, the bottom wall 322 (FIG. 30) includes an upwardly protruding flange 323 aligned with the side wall flanges 319. The insulation material 324 on the front surface of rear panel 314 is of a uniform thickness to afford clearance between the insulation material and flanges 319 and 323. The resulting space 366 (FIG. 22) enables the insertion of a single assembled front panel 368 onto metal door 310.

Figure 23:
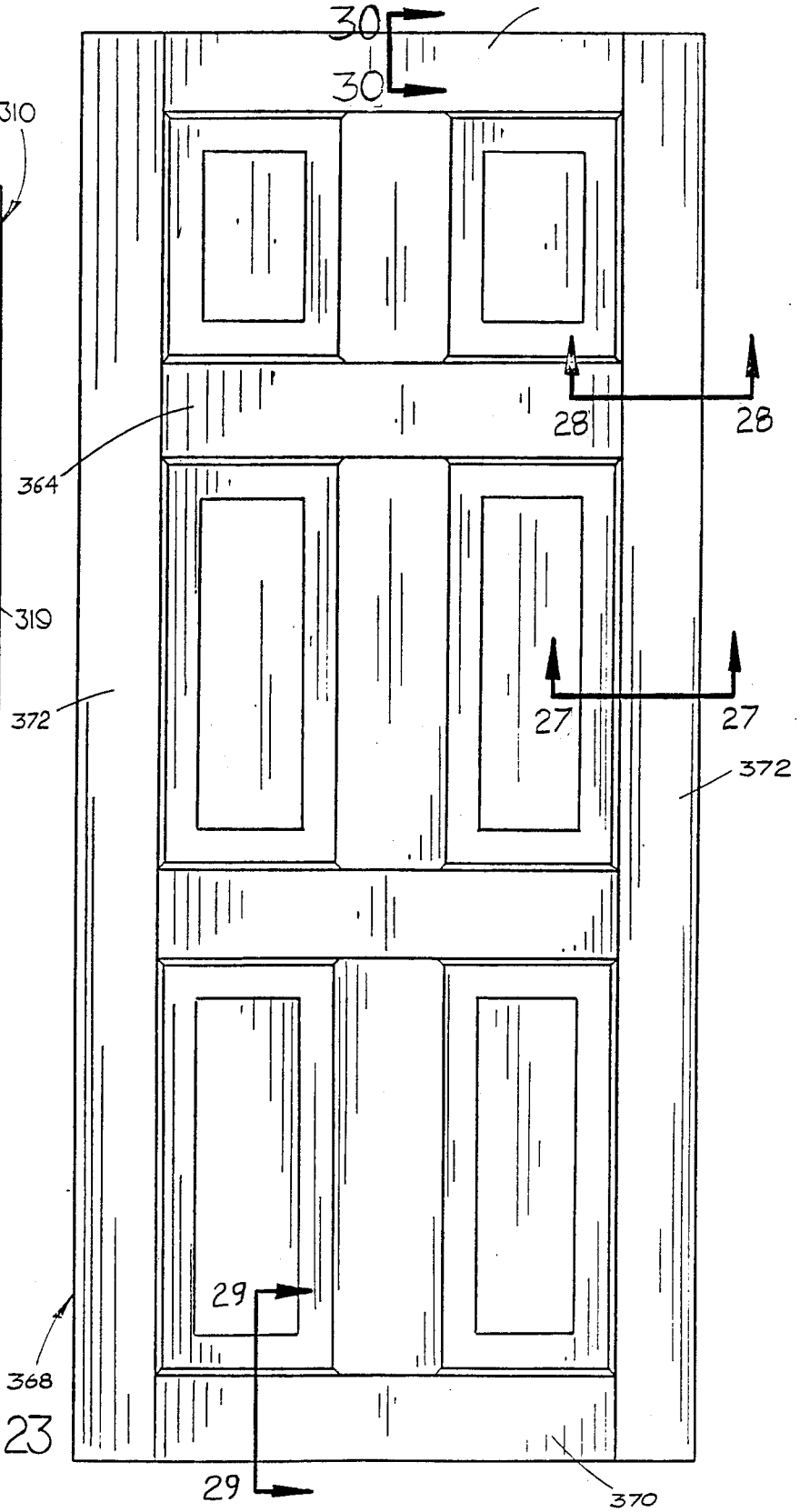
FIG. 23 is an enlarged front elevational view of the door of FIG. 21 with a wood front panel secured thereto.
Figure 24:
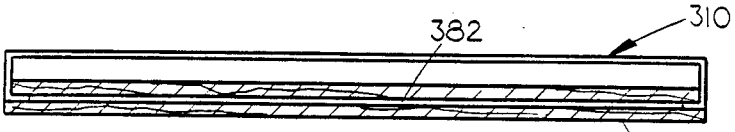
FIG. 24 is a top view of the door of FIG. 23 with the top cap removed.
Figure 25:
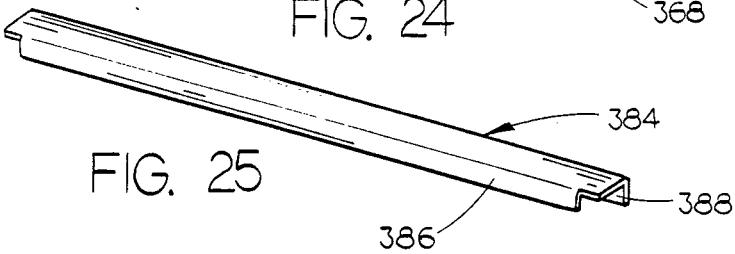
FIG. 25 is a perspective view of the top cap.
Figure 26:
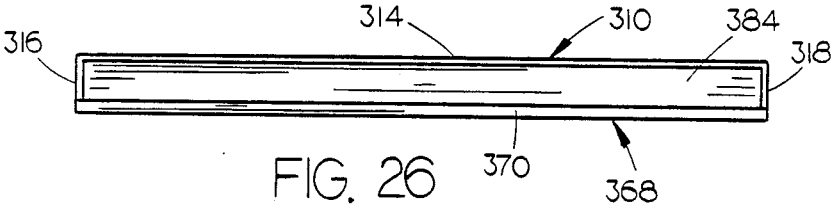
FIG. 26 is a top view of the door with the top cap installed.
Figure 27:
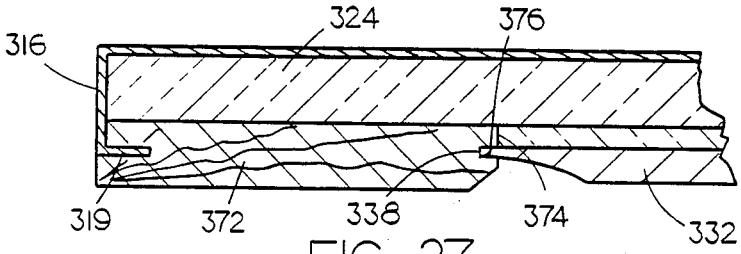
FIG. 27 is an enlarged partial top sectional view taken along line 27—27 in FIG. 23.
Figure 28:
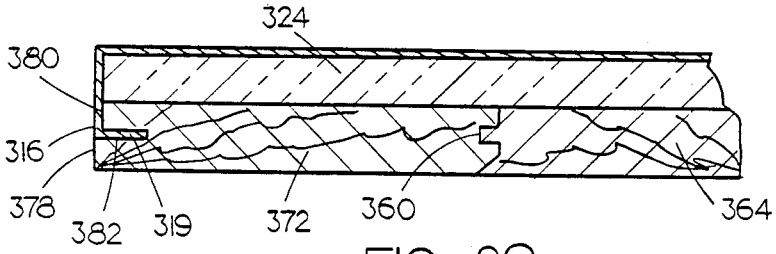
FIG. 28 is an enlarged partial top sectional view taken along line 28—28 in FIG. 23.
Figure 29:
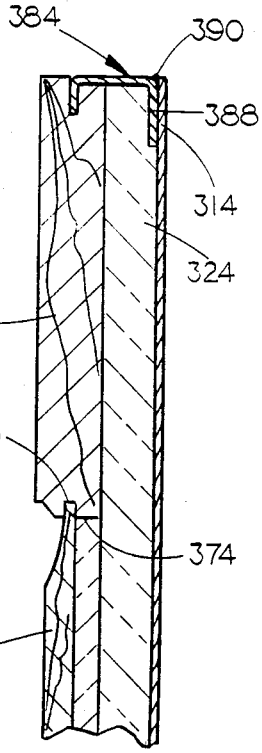
FIG. 29 is an enlarged partial side sectional view taken along line 29—29 in FIG. 23.
Figure 30:
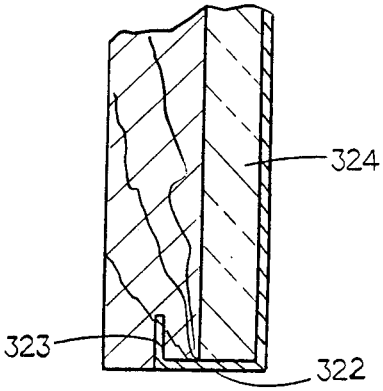
FIG. 30 is an enlarged partial side sectional view taken along line 30—30 in FIG. 23.

Referring to FIGS. 23, 27 and 28, the front panel assembly 368 is essentially identical to the single insert assembly shown in FIG. 20 for the third embodiment described herein except that the moulding strips 234 and 236 are replaced by wood boards 370 and 372. The wood boards 370 and 372 are, of course, wider than the moulding strips 234 and 236 so that the width of the completed front panel assembly 368 is substantially equal to the width of metal door 310. The cross-sectional shape of boards 370 and 372 are shown respectively in FIGS. 29 and 27. There it can be seen that each includes an interior edge 374 having a groove 376 extended therealong for receiving an exterior edge 338 of a raised panel insert 332 or the tongue 360 of a center rail 364 as shown in FIG. 28. The exterior edges 378 of boards 370 and 372 include a depression 380 (FIG. 28) in a rearward portion thereof and a groove 382 for receiving and being filled by the flanges 319 or 323. The depression 380 accommodates receipt of side wall 316, as shown in FIG. 28, for a clean flush surface with the exterior edge 378 of board 372. FIG. 30 illustrates the identical construction for the bottom wall joint.

The single front panel assembly 368, shown in FIG. 23, is preferably assembled together with glue and then inserted as a unit onto the metal door 310 by fitting the top edges of the door flanges 319 into the lower ends of the front panel assembly side grooves 382 and then sliding the two together until the bottom wood board 370 is seated on the flange 323 of bottom wall 323 as shown in FIG. 30. The top of the door is then closed and secured with a top cap 384 shown in FIGS. 25, 26 and 29. Top cap 384 is a generally U-shaped channel member having a downwardly extending front flange 386 similar to flanges 319 and 323 of the door side walls 316 and bottom wall 322. A rear flange 388 fits between the insulation material 324 and rear panel 314, as shown in FIG. 29. The top 384 may be welded to the rear panel 314 along the seam between them as indicated at 390.

This preferred embodiment of FIGS. 21–30 eliminates the need for any veneering and the associated problems of properly applying and maintaining adhesion between the veneering and door.

In an alternate embodiment, the base door 310 could be provided with a nonwood front panel over the insulation material 324 and without the side wall flanges 319. A natural wood front panel assembly 368 is then secured to the front of the base door by adhesives or any other suitable fasteners so that the combined thicknesses of the base door and front panel assembly is generally equal to the thickness of a conventional insulated door. For example, a $\frac{3}{4}$ inch thick front panel may be secured to a one-inch thick base door for a combined thickness of approximately $1\frac{3}{4}$ inches.

Whereas the invention has been described and illustrated in connection with preferred embodiments thereof, it is understood that there are many modifications, substitutions and additions which may be made which are within the intended broad scope of the appended claims. Specific dimensions are not critical to the present invention except to the extent that the resulting door is intended to have the appearance of an all-natural wood door with raised panel inserts. In this connection, the term "raised panel inserts" is intended to be broadly construed to include the conventional raised panel inserts as illustrated in the patent drawings as well as window glazing, flat panels of wood, plastic or any other material or any other type of decorative insert having an exterior edge suitable for receipt within the interior grooves of the surrounding moulding strips of wood boards.

Thus there has been shown and described a natural wood surface treatment for an insulated door which accomplishes at least all of the stated objects.

We claim:

1. In a door including a rear panel of a nonwood material, side walls protruding forwardly from the peripheral side edges of the rear panel and thermal insulation material on the front surface of the said rear panel, the improvement comprising, a plurality of raised panel inserts, a plurality of natural wood boards, each having interior and exterior edges, and a groove formed in the interior edge thereof adapted for receiving one edge of a raised panel insert, said boards arranged around said panels with the edges of said panels received in the grooves in said boards, means for securing said boards relative to one another to define a peripheral framework for supporting said raised panel inserts, means for securing said boards to said door in spaced relation forwardly of said rear panel such that said boards and raised panel inserts define at least a portion of a front panel for said door, and insulation material between said rear panel and said boards and raised panel inserts.

2. The door of claim 1 wherein said raised panel insert and boards span substantially the full width and height of said front panel and said means for securing said boards to said door comprises means for securing said boards to the side walls of the door.

3. The door of claim 2 wherein the means for securing said boards to the side walls of the door comprises inwardly protruding flanges on the side walls, a groove in the exterior periphery of said front panel extending top to bottom whereby said front panel is assembled to said door by slidably receiving said flanges within said peripheral groove.

4. The door of claim 3 wherein said door further comprises a bottom wall protruding forwardly from the bottom peripheral edge of the rear panel and including an upwardly protruding flange aligned with said inwardly protruding flanges on the side walls for receipt within said peripheral groove.

5. The door of claim 4 further comprising a top cap including a generally horizontal top wall, a downwardly protruding flange on said top wall adapted for receipt within said peripheral groove and means for securing said top wall to said door.

6. A substitute for a conventional insulated door having a substantially uniform thickness around the peripheral edge thereof, comprising, a base insulated door including a rear panel of a non-wood material, side walls protruding forwardly from the peripheral side edges of the rear panel and thermal insulation material on the front surface of said rear panel, an auxiliary front panel of natural wood material, and means for securing said auxiliary front panel to said base insulated door forwardly of said thermal insulation material, the combined thickness of said base insulated door and said auxiliary front panel being substantially equal to said uniform thickness of the conventional insulated door.

7. The substitute door of claim 6 wherein said base insulated door further includes a front panel of non-wood material.

8. The substitute door of claim 6 wherein the thicknesses of said conventional door, base insulated door and auxiliary front panel are approximately $1\frac{3}{4}$ inches, 1 inch and $\frac{3}{4}$ inch, respectively.

* * * * *